United States Patent [19]

King

[11] Patent Number: 4,923,625

[45] Date of Patent: May 8, 1990

[54] LUBRICANT COMPOSITIONS

[75] Inventor: James P. King, Lansdale, Pa.

[73] Assignee: Desilube Technology, Inc., Lansdale, Pa.

[21] Appl. No.: 413,968

[22] Filed: Sep. 28, 1989

[51] Int. Cl.[5] ..... C10M 135/10

[52] U.S. Cl. ..... 252/32.5; 252/33; 252/33.2; 252/33.6; 252/39; 252/49.3

[58] Field of Search ..... 252/33, 33.2, 32.5, 252/33.6, 49.3

[56] References Cited

U.S. PATENT DOCUMENTS

| | | | |
|---|---|---|---|
| 2,588,234 | 3/1952 | Henricks | 252/18 |
| 2,903,384 | 9/1959 | Grass et al. | 148/270 |
| 2,957,825 | 10/1960 | Henricks | 252/18 |
| 3,082,129 | 3/1963 | Henricks | 148/246 |
| 3,186,945 | 6/1965 | Graue et al. | 427/372.2 |
| 3,377,279 | 4/1968 | Sibert | 252/25 |
| 3,505,222 | 4/1970 | Niebykski | 252/17 |
| 3,505,223 | 4/1970 | Niebykski | 252/25 |
| 4,675,121 | 6/1987 | Root et al. | 252/25 |

*Primary Examiner*—Jacqueline V. Howard
*Assistant Examiner*—Ellen McAvoy
*Attorney, Agent, or Firm*—Paul Lipsitz

[57] ABSTRACT

A lubricant composition having improved extreme pressure and antiwear properties comprising a base lubricant and an additive consisting of from about 0.01 to about 30 weight percent of said lubricant of a mixture of a metal thiosulfate and a metal phosphate.

12 Claims, No Drawings

LUBRICANT COMPOSITIONS

This invention relates to a lubricant composition containing synergistic mixture of a metal thiosulfate and a metal phosphate to impart both extreme pressure and antiwear properties to a base lubricant.

BACKGROUND OF THE INVENTION

There is an increase in demand for high performance, non-hazardous and environmentally safe lubricant additives for greases, oils, metal working fluids, and compositions such as mineral oils and aqueous based synthetic fluids used in metal forming operations such as wire drawing and metal forging. In the case of greases and oils which have incidental contact with food, very few lubricant additives are available which satisfy both the required non-toxic properties and the performance needed by modern machinery. In formulating metal working fluids for cutting, grinding, broaching, tapping, and the like, certain sulfur-, chlorine-, and phosphorus-containing compounds are generally used as the extreme pressure and antiwear additives. However, the presence of chlorine-containing compounds may result in certain difficulties including corrosion and disposal problems. In metal forming operations like metal drawing and forging, molybdenum disulfide and other metal sulfides are commonly employed. Subsequent treatment of the work pieces is usually required to remove the residual sulfides by means of an acid pickling bath or mechanical descaling. Disposal of the sludges from acid pickling bath may present environmental hazards and can be quite expensive due to the presence of heavy metals.

Accordingly, one object of this invention is to provide a lubricant containing synergistic additives that impart both extreme pressure and antiwear properties to the base lubricant. Another object is to provide lubricants with the synergistic additives that are non-hazardous, environmentally safe, and easily disposed of after use.

DISCUSSION OF PRIOR ART

Many conventional lubricant additives are based on chlorinated and sulfurized oils, molybdenum disulfide and antimony compounds. Metal thiosulfates have been disclosed as extreme pressure additives in various lubricants (U.S. Pat. Nos. 3,505,222 and 3,505,223) and in metal working and wire drawing formulations (U.S. Pat. Nos. 2,903,384, 2,957,825 and 3,082,129). However, in such disclosures, the presence of the metal thiosulfates provides only extreme pressure properties, but no antiwear properties.

U.S. No. 4,675,121 discloses that phosphate salt—oil soluble sulfur systems are useful as additives for an extreme pressure lubricant. U.S. No. 3,186,945 discloses a mixture of a viscous soluble potassium polyphosphate with one or more of alkali metal borates, alkali metal sulfates, alkali metal chlorides, alkali metal fluorides or alkali metal chromates, which mixtures are said to be useful aqueous based oil and fat-free lubricants. Such a system, however, does not provide the extreme pressure properties obtained with a thiosulfate component.

U.S. No. 2,588,234 discloses a water soluble phosphating lubricant wherein an integral phosphate coating put on carbon steel and a stepwise lubricant film is also deposited. The bath used is comprised of an organic film forming material, (diethylene glycolstearate or sodium stearate), mono-sodium phosphate and sodium thiosulfate. An integral iron phosphate coating is formed in the acidic medium formed by the mono-sodium phosphate accelerated by sodium bisulfite which is obtained by reaction of the sodium thiosulfate and sodium phosphate. On drying, the final coating is one of phosphate, sulfur (from decomposition of the bisulfite) and the stearate lubricant.

DETAILED DESCRIPTION OF THE INVENTION

The present invention, as indicated above, relates to a lubricant containing a synergistic mixture of a metal thiosulfate and a metal phosphate and its use, which lubricant will not only provide the superior extreme pressure properties of a metal thiosulfate but also will impart antiwear characteristics which cannot be achieved by employing either one of the components alone. These synergistic mixtures are, in general, non-hazardous and safe. Unlike molybdenum disulfide, graphite, chorinated and sulfurized hydrocarbons, they are colorless, odorless, water-soluble, and easily disposed of in an environmentally safe manner. The residual film deposited on a work piece after drawing or forging operations can be readily removed with an alkali bath, thus eliminating the use of an acid pickling bath or mechanical descaling. This is particularly advantageous as it permits the use of the invention for food grade lubricants since both thiosulfates and phosphates used in the invention are on the GRAS list and, further, the waste water from the residual film removing operation can be easily disposed without environmental problems.

The amount of the synergistic mixture of the invention and the ratio of metal thiosulfate to metal phosphate can vary over a wide range depending upon the base lubricant employed and the specific application for which the lubricant is designed. Generally good results are obtained when from about 0.01 to 30 weight percent of the synergistic mixture is added to the lubricant. A preferred range is from about 0.05 to 20 percent by weight. The weight ratio of a metal thiosulfate to metal phosphate may range from about 1:99 to about 99:1. A preferred ratio is from about 30:70 to about 70:30 and still more preferably about 20:80 to about 80:20. These mixtures may or may not be soluble in the base liquid lubricants and may be suspended as a fine powder with, if necessary, a suspending agent such as an oil soluble succinimide.

The metal thiosulfates used in the invention are made with any metal that is capable of forming a metal thiosulfate salt. Typical examples are lithium, sodium, potassium, manganese, calcium, barium, strontium, titanium, zirconium, cadminum, zinc, nickel, cobalt, copper, iron, magnesium, lead, tin, silver, and the like, as well as mixtures of the above. When water is the base lubricant it is most desirable to use an alkali metal or ammonium thiosulfate.

Another useful class of metal thiosulfate is represented by the metal salts of Bunte acids as shown in the following formula:

$$(R-S-\overset{\overset{\displaystyle O}{\|}}{\underset{\underset{\displaystyle O}{\|}}{S}}-O)_nM$$

where R represents a hydrocarbon radical containing from 1 to about 30 carbon atoms, M is a metal including those thiosulfate-forming metals listed above and n in the valence of M. The radical R may be substituted with a non-hydrocarbon group such as chloro, bromo, hydroxyl, carboxyl, carbonyl, and the like. Some representative examples of the Bunte salts are sodium ethyl thiosulfate, potassium benzyl thiosulfate and barium isoamyl thiosulfate. These compounds can be prepared by reacting an alkyl halide with sodium thiosulfate.

The preferred metal thiosulfates are the alkali metal thiosulfates, alkaline earth thiosulfate and ammonium thiosulfate.

The metal phosphate used in the invention may be selected from any one of the alkali, alkaline earth, and ammonium phosphates. Some representative examples of these phosphates are sodium phosphate (mono, di and tribasic), sodium pyrophosphate, sodium heptaphosphate, sodium tripolyphosphate, sodium hexametaphosphate, sodium hypophosphate, sodium trimetaphosphate, potassium metaphosphate, ferric sodium phosphate, and calcium glycophosphate.

The synergistic mixture may be used with a wide variety of base lubricants such as oils, greases, synthetic lubricants, water-based lubricants, lubricant powders, and the like. The invention is particularly useful with greases and, more specifically, with lithium based greases, clay greases, urea greases, and aluminum complex greases and is also of particular value with oils and water based synthetic fluids of lubricating viscosity used in cutting and grinding operations. The following examples illustrate the wide utility of the invention.

EXAMPLES

Example 1

A lithium grease is blended with (a) 1% sodium pyrophosphate decahydrate, (b) 1% sodium thiosulfate pentahydrate, and (c) a mixture of 0.5% sodium thiosulfate pentahydrate and 0.5% sodium pyrophosphate decahydrate. The data are recorded in Table I. The grease containing the mixture provides smaller wear diameter than the grease containing 1% sodium thiosulfate pentahydrate or the grease with 1% sodium pyrophosphate decahydrate, thus showing the significant synergistic effect.

Example 2

Similarly, a lithium grease is blended with (a) 1% sodium phosphate (tribasic) dodecahydrate, (b) 1% sodium thiosulfate pentahydrate, and (c) a mixture of 0.5% sodium thiosulfate pentahydrate and 0.5% sodium phosphate (tribasic) dodecahydrate. From the data in Table I, it is seen that the grease containing the mixture of the invention provides the best antiwear characteristics and the data clearly show the synergistic effect.

Example 3

Wear diameters are obtained on an aluminum complex grease containing (a) 1% sodium pyrophosphate decahydrate, (b) 1% sodium thiosulfate pentahydrate, and (c) a mixture of 0.5% sodium thiosulfate pentahydrate and 0.5% sodium pyrophosphate decahydrate. The data in Table II shows that the grease containing the mixture provides the smallest wear diameter.

Example 4

In a white mineral oil of 160 SU5 viscosity is suspended (a) 2% sodium thiosulfate (anhydrous), (b) 2% sodium pyrophosphate decahydrate and (c) a mixture of 1% sodium thiosulfate (anhydrous) and 1% sodium pyrophosphate decahydrate. In all of these three suspensions, an oil-soluble succinimide (2%) is used as a suspending agent. The wear diameters are obtained on a Four-Ball wear tester. The data are recorded in Table III. The smallest wear diameter is obtained on the suspension containing a mixture of 1% sodium thiosulfate (anhydrous) and 1% sodium pyrophosphate decahydrate (c), again illustrating synergism with the two components on the antiwear characteristics of the lubricant.

Example 5

In a synthetic hydrocarbon fluid (polyalpha-olefin) having a viscosity of 40 cs is suspended (a) 2% sodium thiosulfate (anhydrous), (b) 2% sodium pyrophosphate and (c) a mixture of 1% sodium thiosulfate (anhydrous) and 1% sodium pyrophosphate decahydrate. As shown in Table III, the smallest wear diameter is obtained with the suspension containing the mixture of the invention and the synergistic effect is evident.

Example 6 through 9

Four water-base synthetic fluids are formulated and the lubricating properties of these fluids are determined on a Falex tester. Experimental data are recorded in Table IV. These examples illustrate the synergism obtained with a mixture of sodium thiosulfate and sodium pyrophosphate with respect to antiwear characteristics in an aqueous medium and the examples also illustrate that borax or other alkali are useful to raise the pH of this aqueous system without adversely affecting the system's lubricating properties. Raising the pH is desirable because the thiosulfate acts as a reducing agent in an aqueous system and this is easily countered by raising the pH to a value of at least about 7 to about 9. Other typical agents which are useful instead of borax are sodium sulfite, sodium bisulfite, and sodium benzoate. Amyl alcohol may also be used to mitigate the reducing properties of the sodium thiosulfate. The use of a pH of at least about 7 for the water based fluids of the invention is important in order to avoid the decomposition of the thiosulfate which would occur under aqueous acid conditions. The data show that sodium thiosulfate and sodium pyrophosphate by themselves exhibit excellent EP properties but inferior antiwear characteristics. The outstanding antiwear characteristic of the fluids containing a mixture of sodium thiosulfate and sodium pyrophosphate are shown by the lower numbers of teeth and pin weight losses (Examples 6 and 7) in comparison with those containing only sodium thiosulfate or sodium pyrophosphate (Examples 8 and 9.)

Example 10

A solid lubricant for wire drawing is prepared which consists of 95% by weight of calcium stearate, 2.5% of sodium thiosulfate and 2.5% of trisodium phosphate. This lubricant in granular form is placed in the hopper of a wire drawing apparatus for drawing stainless steel. The steel is readily drawn to wire and the residual coating removed with an aqueous alkaline bath.

The solid lubricant of this example effectively replaces the conventional molybdenum disulfide which requires an acid bath to clean the drawn wire and which bath removes chromium from the steel, thus making it an environmental hazard difficult to dispose.

The thiosulfate and phosphate may be premixed to make the lubricant additive which will be used as described above.

As indicated, the mixture of thiosulfate and phosphate may be used in a wide variety of lubricant compositions which will have numerous applications. It will also be understood that various formulations with additives for specific purposes may be used in the lubricants of the invention as will be clear to the skilled art worker.

TABLE I

WEAR CHARACTERISTICS OF LITHIUM GREASE CONTAINING VARIOUS ADDITIVES

| Example | | Grease Composition | Wear Diam[1] mm |
|---|---|---|---|
| 1 | (a) | L.G.[w] + 1% $Na_4P_2O_7.10H_2O$ | 0.63 |
| | (b) | L.G. + 1% $Na_2S_2O_3.5H_2O$ | 0.62 |
| | (c) | L.G. + 0.5% $Na_4P_2O_7.10H_2O$ + 0.5% $Na_2S_2O_3.5H_2O$ | 0.45 |
| | (d) | L.G. + 0.8% $Na_4P_2O_7.10H_2O$ + 0.2% $Na_2S_2O_3.5H_2O$ | 0.52 |
| | (e) | L.G. + 0.2% $Na_4P_2O_7.10H_2O$ + 0.8% $Na_2S_2O_3.5H_2O$ | 0.55 |
| 2 | (a) | L.G. + 1% $Na_3PO_4.12H_2O$ | 0.88 |
| | (b) | L.G. + 1% $Na_2S_2O_3.5H_2O$ | 0.62 |
| | (c) | L.G. + 0.5% $Na_3PO_4.12H_2O$ + 0.5% $Na_2S_2O_3.5H_2O$ | 0.55 |

[w]L.G. = Lithium Grease
[1]ASTM D 2266 - 1200 rpm, 40 kg load, 75° C. for 60 mins. using AI32-52100 steel balls

TABLE II

WEAR CHARACTERISTICS OF ALUMINUM COMPLEX GREASE CONTAINING VARIOUS ADDITIVES

| Example | | Grease Composition | Wear Diam[1] mm |
|---|---|---|---|
| 3 | (a) | A.C.[w] + 1% $Na_4P_2O_7.10H_2O$ | 0.68 |
| | (b) | A.C. + 1% $Na_2S_2O_3.5H_2O$ | 0.67 |
| | (c) | A.C. + 0.5% $Na_4P_2O_7.10H_2O$ + 0.5% $Na_2S_2O_3.5H_2O$ | 0.65 |

[w]A.C. = Aluminum Complex Grease
[1]ASTM D 2266 - 1200 rpm, 40 kg load, 75° for 60 min. using AISI-52100 steel balls

TABLE III

WEAR CHARACTERISTICS OF A WHITE MINERAL OIL AND A SYNTHETIC POLYALPHA-OLEFIN CONTAINING VARIOUS ADDITIVES

| Example | | Fluid Composition | Wear Diam[1] mm |
|---|---|---|---|
| 4 | (a) | White Mineral Oil (WMO) + 2% $Na_2S_2O_3$ | 0.79 |
| | (b) | WMO + 2% $Na_4P_2O_7.10H_2O$ | 0.74 |
| | (c) | WMO + 1% $Na_2S_2O_3$ + 1% $Na_4P_2O_7.10H_2O$ | 0.68 |
| 5 | (a) | Polyalpha-olefin (PAO) + $Na_2S_2O_3$ | 0.87 |
| | (b) | PAO + 2% $Na_4P_2O_7.10H_2O$ | 0.98 |
| | (c) | PAO + 1% $Na_2S_2O_3$ + 1% $Na_4P_2O_7.10H_2O$ | 0.72 |

[1]ASTM D-2266 - 1200 rpm, 40 kg load, 75° C. for 60 mins. using AISI-52100 steel balls

TABLE IV

EXTREME PRESSURE AND ANTIWEAR PROPERTIES OF AN AQUEOUS MEDIUM CONTAINING VARIOUS ADDITIVES

| Example: | 6 | 7 | 8 | 9 |
|---|---|---|---|---|
| | Concentrated formula | | | |
| Ingredient | A | B | C | D |
| $Na_2S_2O_3$ | 1.0 | 1.0 | 2.0 | 0 |
| $Na_4P_2O_7.10H_2O$ | 1.0 | 1.0 | 0 | 2.0 |
| Borax | 0 | 1.0 | 0 | 0 |
| Caprylic Acid | 3.0 | 3.0 | 3.0 | 3.0 |

TABLE IV-continued

EXTREME PRESSURE AND ANTIWEAR PROPERTIES OF AN AQUEOUS MEDIUM CONTAINING VARIOUS ADDITIVES

| Example: | 6 | 7 | 8 | 9 |
|---|---|---|---|---|
| Ethanolamine | 1.5 | 1.5 | 1.5 | 1.5 |
| Propropylene glycol | 12.0 | 12.0 | 12.0 | 12.0 |
| Water | 81.5 | 80.5 | 81.5 | 81.5 |
| | 100.0 | 100.0 | 100.0 | 100.0 |
| | 5% A | 5% B | 5% C | 5% D |
| $Na_2S_2O_3$, % | 0.05 | 0.05 | 0 | 0.10 |
| $Na_4P_2O_7.10H_2O$, % | 0.05 | 0.05 | 0.10 | 0 |
| pH | 7–8 | 8.5–9 | 7–8 | 7–8 |
| Falex Test Results | | | | |
| Wear 15 min. + 1000 lbs.[1] | | | | |
| Number of Teeth | 12 | 18 | 28 | 43 |
| Pin weight loss, mg | 3.1 | 5.3 | 35.6 | 59.6 |
| EP Load, 250 lb. increment[2] | 3750 | 3750 | >4500 | 3750 |

[1]ASTM D-2670-81
[2]ASTM D-3233-86 (Method B) using SAE-3135 steel pins and AISI-1137 steel V-blocks

I claim:

1. A lubricant composition having extreme pressure and antiwear properties comprising a base lubricant and a synergistic additive mixture consisting of from about 0.01 to about 30 weight percent of said lubricant of a mixture of a metal thiosulfate and a metal phosphate, the weight ratio of thiosulfate to phosphate being from about 1:99 to about 99:1.

2. A lubricant composition having extreme pressure and antiwear properties comprising a base lubricant and a synergistic additive mixture consisting of from about 0.05 to about 20 weight percent of said lubricant of a mixture of an alkali metal, ammonium or alkaline earth thiosulfate and an alkali metal, ammonium or alkaline earth metal phosphate, the weight ratio of thiosulfate to phosphate being from about 30:70 to about 70:30.

3. The lubricant composition of claim 2 wherein the lubricant is a grease.

4. The lubricant composition of claim 2 wherein the lubricant is a lithium grease or an aluminum complex grease.

5. The lubricant composition of claim 2 wherein the lubricant is a mineral oil or a hydrocarbon fluid of lubricating viscosity.

6. The lubricant composition of claim 2 wherein the lubricant is a lubricant powder.

7. The lubricant composition of claim 2 wherein the lubricant is an aqueous synthetic fluid having a pH of at least about 7.0.

8. A synergistic mixture useful as a lubricant additive having extreme pressure and antiwear properties comprising a mixture of an alkali metal or ammonium thiosulfate and an alkali metal, ammonium, or alkaline earth metal phosphate, the weight ratio of thiosulfate to phosphate being from about 30:70 to about 70:30.

9. A method of imparting extreme pressure and antiwear properties to a lubricant which comprises blending with a base lubricant in an amount of from about 0.05 to about 20 weight percent of said lubricant, an additive mixture comprising an alkali metal, ammonium or alkaline earth thiosulfate and an alkali metal, ammonium or alkaline earth phosphate, the weight ratio of thiosulfate to phosphate being from about 30:70 to about 70:30.

10. The method of claim 9 wherein the base lubricant is a lithium or an aluminum complex grease.

11. The method of claim 9 wherein the base lubricant is a lubricant powder.

12. The method of claim 9 wherein the base lubricant is an aqueous synthetic fluid having a pH of at least about 7.0.

* * * * *